US010414020B2

(12) United States Patent
Takada et al.

(10) Patent No.: US 10,414,020 B2
(45) Date of Patent: Sep. 17, 2019

(54) GRINDSTONE AND GRINDING/POLISHING DEVICE USING SAME

(71) Applicant: NANO TEM CO., LTD., Nagaoka-shi, Niigata (JP)

(72) Inventors: Atsushi Takada, Nagaoka (JP); Masakazu Takatsu, Mitsuke (JP); Kyosuke Ohashi, Nagaoka (JP); Kazuya Horie, Sanjo (JP); Kozo Ishizaki, Nagaoka (JP)

(73) Assignee: NANO TEM CO., LTD., Nagaoka-shi, Niigata (JP)

( * ) Notice: Subject to any disclaimer, the term of this patent is extended or adjusted under 35 U.S.C. 154(b) by 0 days.

(21) Appl. No.: 14/433,956

(22) PCT Filed: Sep. 27, 2013

(86) PCT No.: PCT/JP2013/076164
§ 371 (c)(1),
(2) Date: Apr. 7, 2015

(87) PCT Pub. No.: WO2014/061423
PCT Pub. Date: Apr. 24, 2014

(65) Prior Publication Data

US 2015/0258656 A1 Sep. 17, 2015

(30) Foreign Application Priority Data

Oct. 20, 2012 (JP) ..... 2012-232441

(51) Int. Cl.
*B24B 37/12* (2012.01)
*B24B 7/22* (2006.01)

(52) U.S. Cl.
CPC ..... *B24B 37/12* (2013.01); *B24B 7/228* (2013.01)

(58) Field of Classification Search
CPC ..... B24B 37/12; B24B 7/228; B24B 37/14; B24B 7/22; B24B 7/20; B24D 7/063;
(Continued)

(56) References Cited

U.S. PATENT DOCUMENTS 5,942,015 A * 8/1999 Culler ..... B24D 3/28 51/294
5,958,794 A * 9/1999 Bruxvoort ..... B24B 7/228 216/88

(Continued)

FOREIGN PATENT DOCUMENTS

GB 1067767 A * 5/1967 ..... B24D 7/063
JP 63-150163 A 6/1988

(Continued)

OTHER PUBLICATIONS

International Search Report dated Jan. 7, 2014, issued in corresponding application No. PCT/JP2013/076164.

*Primary Examiner* — Christopher M Koehler
*Assistant Examiner* — Joel Crandall
(74) *Attorney, Agent, or Firm* — Westerman, Hattori, Daniels & Adrian, LLP

(57) ABSTRACT

[Problem] To provide a grindstone and a grinding/polishing device using same with which, in addition to it being possible to perform the three processes of rough processing, lapping, and polishing with the same device: double-sided processing is also possible; processing rate does not decrease even when used continuously; and dressing can be omitted.

[Solution] A grindstone for grinding/polishing workpieces, the grindstone being characterized in comprising multiple grindstone pillars, which are obtained from a binding agents and abrasive grains for grinding/polishing the workpieces and disposed in parallel with an axis (L) in the depth direction of the grinding/polishing surface, and the grindstone matrix integrally formed with the grindstone pillars, and a grinding/polishing device using said grindstone.

11 Claims, 5 Drawing Sheets

(58) Field of Classification Search
CPC ..... B24D 7/06; B24D 18/00; B24D 18/009; B24D 18/0009
See application file for complete search history.

(56) References Cited

U.S. PATENT DOCUMENTS

| | | | | |
|---|---|---|---|---|
| 6,454,644 | B1 * | 9/2002 | Miyazaki | B24B 37/245 451/526 |
| 7,445,847 | B2 * | 11/2008 | Kulp | B24B 37/24 428/423.1 |
| 2002/0077037 | A1 * | 6/2002 | Tietz | B24B 37/205 451/41 |
| 2004/0005850 | A1 * | 1/2004 | Stepanovich | B24D 3/28 451/177 |
| 2007/0026770 | A1 * | 2/2007 | Fletcher | B24B 7/228 451/41 |

FOREIGN PATENT DOCUMENTS

| | | | |
|---|---|---|---|
| JP | 64-040279 | A | 2/1989 |
| JP | 01-193174 | A | 8/1989 |
| JP | 09-057614 | A | 3/1997 |
| JP | 2000-198073 | A | 7/2000 |
| JP | 2001-088017 | A | 4/2001 |
| JP | 2004-528184 | A | 9/2004 |
| JP | 2008-006529 | A | 1/2008 |

* cited by examiner

10 GRINDSTONE

11 WORKING SURFACE

12 BASE END SURFACE

15 POLISHING LAYER

16 GRINDSTONE BASE 17,18 FLUID FLOW PATH

19 SUPPLY/DISCHARGE PORT

25 VACUUM PUMP

29 PRESSURE PUMP

GRINDSTONE AND GRINDING/POLISHING DEVICE USING SAME

TECHNICAL FIELD

The present invention relates to a grindstone configured to grind/polish a workpiece and a grinding/polishing device using the grindstone. More specifically, the present invention relates to the grindstone configured to grind/polish workpieces such as ceramics, a silicon wafer, SiC, alumina, sapphire, metal, and alloy, and the grinding/polishing device using the grindstone.

BACKGROUND ART

A grindstone is a tool formed of hard particles, namely, abrasive grains with binding agents. Processings using the grindstone include grinding and polishing, and in general, rough processing is referred to as grinding, and finishing is referred to as polishing. These processings are the processing to scrape a workpiece surface, namely, a surface to be processed with the abrasive grains into debris by relatively moving a grindstone and the workpiece while the grindstone is being pushed against the workpiece. In the present specification, note that grinding/polishing indicates both grinding and/or polishing.

The grinding/polishing processing using a grindstone includes: cylindrical grinding/polishing to process a cylindrically-shaped outer peripheral surface of a workpiece; inner surface grinding/polishing to process a cylindrically-shaped inner peripheral surface of a workpiece; and flat surface grinding/polishing to process a flat surface of a workpiece. As the grindstone to process the outer peripheral surface and the inner peripheral surface, a grindstone provided with a cylindrically-shaped working surface is used. Further, as a grindstone to process a flat surface, a cylindrically-shaped grindstone provided with a working surface on an outer peripheral surface or a grindstone having a cup-shape, a ring-shape, or a disk-like shape and including a working surface on a flat side surface is used.

In relation to the grindstones, various kinds of methods are proposed in the related arts. For example, JP 63-150163 A (Patent Literature 1 listed below) discloses a grindstone with a structure including a three-dimensional net-like composition where abrasive grain particles are bonded with synthetic resin and continuous pores are provided, wherein a volume ratio of the abrasive grains, bonding strength, etc. are specified. The invention disclosed in Patent Literature 1 is similar to the present invention in a point of, for example, having a structure where the abrasive grains are bonded with the synthetic resin.

Further, JP 64-40279 A (Patent Literature 2 listed below) discloses a polishing tool member in which abrasive grains are ceramic fibers or metal wires in an abrasive fixed type polishing member in which the abrasive grains are fixed on a bond layer, and the fibers wires are arranged such that longitudinal sides thereof intersect with a polishing surface.

Additionally, JP 2000-198073 A (Patent Literature 3 below) discloses a polishing grindstone including: aggregated abrasive grains formed by aggregating a plurality of ultra-fine abrasive grains; and a resin that forms a grindstone by kneading and solidifying the aggregated abrasive grains. However, the inventions disclosed in Patent Literatures 1 to 3 are different in a point of not including grindstone pillars arranged in parallel and each having an axis L in a depth direction of a grinding/polishing surface, unlike the present invention.

CITATION LIST

Patent Literatures

Patent Literature 1: JP 63-150163 A
Patent Literature 2: JP 64-040279 A
Patent Literature 3: JP 2000-198073 A

SUMMARY OF INVENTION

Technical Problems

In most cases, especially, a material such as an electronic material includes hard and fragile workpieces and has difficult processability, and this fact leads to high product cost. Generally, according to a processing method for such a material, rough processing is first performed with a grindstone using diamond or the like, next lapping is performed, and finally polishing is performed.

According to the grinding by the grindstone in the related arts, high-speed processing can be performed, however; a finished surface is rough and defects may be generated on a material surface and beneath the surface. The rough processing is not suitable to obtain high dimensional accuracy because its processing speed is generally fast. The polishing is performed normally by floating abrasive grains, has its demerit in the slow processing speed, removes defects located near the surface, and forms smooth surfaces with high dimensional accuracy. The lapping is a processing method performed between the above two processing. Normally, these three processes are performed by different machines and slowly carried out, and further extra work to change the machines is required between the respective processes.

Considering such situations, the present invention is directed to providing a grindstone and a grinding/polishing device using the same, in which the three processes of the rough processing, lapping, and polishing can be performed under the same device, double-surface processing can be performed, a processing speed does not decrease even in the case of continuous use, and dressing of grindstones can be omitted or the number of dressing times thereof can be reduced.

Solution to Problem

The present invention is achieved to solve the above-described problems as a result of earnest study on grindstone structure, and the gist of the present invention is recited as follows in accordance with the scope of claims.

(1) A grindstone configured to grind/polish workpieces, comprising:

multiple grindstone pillars arranged in parallel, including binding agents and abrasive grains configured to grind/polish the workpieces, and each having an axis L in a depth direction of a grinding/polishing surface; and a grindstone matrix integrally formed with the grindstone pillars, wherein both the grindstone pillars and the grindstone matrix include abrasive grains and binding agents, abrasive grains inside grindstone pillars have hardness higher than abrasive grains inside the grindstone matrix.

(2) The grindstone according to (1), wherein a surface configured to grind/polish the workpieces is a flat surface or a curved surface.

(3) The grindstone according to (1) or (2), wherein the grindstone pillars and the grindstone matrix are porous bodies having porosity of 20 to 60 volume %.

(4) The grindstone according to (3), wherein cooling liquid, gas, slurry containing a chemical polishing agent, or mixture of the cooling liquid, gas, and slurry is injected between the workpieces and the grindstone via the pores.

(5) The grindstone according to (3), The grindstone according to claim 3, wherein the pressure between the workpieces and the grindstone is reduced via the pores by using a vacuum device such as a vacuum pump.

(6) The grindstone according to any one of (1) to (5), wherein double-surface processing is possible to be performed by attaching the grindstones to both surfaces of workpieces.

(7) The grindstone according to any one of (1) to (6), wherein the grindstone is prevented from clogging and processing is possible to be continuously performed by directly discharging liquid and gas in a continuous or pulse-like manner from a rear portion of the grinding/polishing surface of the grindstone.

(8) The grindstone according to anyone of (1) to (7), wherein workpieces are prevented from being adhered to the grinding/polishing surface, and the workpieces are easily removed after processing by directly discharging liquid and/or gas from the rear portion of the grinding/polishing surface of the grindstone.

(9) A grinding/polishing device using a grindstone according to any one of (1) to (8).

Advantageous Effects of Invention

According to the present invention (1), the multiple grindstone pillars arranged in parallel, including binding agents and abrasive grains configured to grind/polish the workpiece, and each having the axis L in the depth direction of the grinding/polishing surface are provided. Therefore, even when an abrasive grain exposed on the grinding/polishing surface falls off, a processing speed can be maintained by exposing an abrasive grain buried in a lower layer while continuing grinding/polishing. Further, both the grindstone pillars and the grindstone matrix include abrasive grains and binding agents, the abrasive grains inside the grindstone pillars have hardness higher than the abrasive grains inside the grindstone matrix. Therefore, the grindstone matrix has more abrasion than the grindstone pillars, and the grindstone matrix sinks deeper than the grindstone pillars. This phenomenon is also enhanced by a difference of Young's moduli. As a result, the abrasive grains of abrasive grain pillars can be kept exposed on the grindstone surface, and a hard and fragile workpiece such as an electronic material can be ground/polished.

According to the present invention (2), the surface configured to grind/polish the workpiece is a flat surface or a curved surface, thereby achieving to perform grinding/polishing not only in the case where the workpiece is flat shaped but also in accordance with a shape of a workpiece by arranging the multiple grindstone pillars in a form of the curved surface at an outer periphery of the disk-like shaped grindstone. The multiple grindstone pillars are arranged in parallel and each thereof has the axis L in a radial direction of the disk-like shape. Additionally, the processing speed can be increased.

According to the present invention (3), the grindstone pillars and the grindstone matrix can be provided the following effect by being a porous body of the porosity 20– the 60 volume %.

By forming the grindstone pillars as the porous bodies, the grindstone surface can be vacuumed and a distance between the abrasive grains and a grinding object can be made closer.

By forming the grindstone as the porous body, the distance between the grindstone and the grinding object can be controlled, by directly discharging the coolant such as water.

Cooling and polishing in the grindstone processing can be performed by directly discharging the coolant such as water from the grindstone.

According to the present invention (4), cooling liquid, slurry containing a chemical polishing agent, or mixture thereof is supplied between the workpieces and the grindstone via the pores, and dimensional accuracy of polishing can be obtained by raising the grindstone from the workpieces by slowing down of the processing speed.

According to the present invention (5), pressure between the workpieces and the grindstone can be reduced by using a vacuum device such as a vacuum pump via the pores, and the processing speed can be raised due to the abrasive grains working into the workpieces efficiently.

Number of the abrasive grains in the grindstone touching the workpieces can be lessen extremely, and each abrasive grain can act on the workpieces by high pressure, small number of the abrasive grains contribute to grinding largely, abrasive grain takes place grinding, and worn out and becomes dull simultaneously. The dressing work for usually preparing the form of dressing work or a setting grindstone is necessary. The grindstone of the present invention is applied large force after grinding, due to the small number of effective abrasive grains, and the small worn out abrasive grain falls off. After falling off, next abrasive grain being aside expose due to the pores body and remaining hole part.

According to the present invention (6), double-surface processing can be performed by attaching the grindstones to both surfaces of the workpiece.

According to the present invention (7), the grindstone is prevented from clogging and the processing can be continuously performed by directly discharging liquid and gas in a continuous or pulse-like manner from the rear portion of the grinding/polishing surface of the grindstone.

According to the present invention (8), the workpiece is prevented from being adhered to the grinding/polishing surface, and the workpiece can be easily removed after processing by directly discharging liquid and gas from the rear portion of the grinding/polishing surface of the grindstone.

According to the present invention (9), a grinding/polishing device providing following functions and effects can be achieved by using the grindstone according to any one of (1) to (8).

Vacuuming can be performed from a grindstone surface.

A mechanism capable of discharging coolant such as water from the grindstone can be implemented.

Dressing for a grinding stone can be omitted.

Rough grinding, lapping grinding, finishing polishing can be simultaneously performed.

Double-surface processing can be performed.

The grindstone can be prevented from clogging and processing can be continuously performed.

A workpiece is prevented from being adhered to the grinding/polishing surface, and can be easily removed after processing.

According to the present invention, it is possible to provide the grindstone and the grinding/polishing device using the same, in which the three processes of the rough processing, lapping, and polishing can be performed in the same device, further the double-surface processing can be performed, the processing speed does not decrease even in the case of continuous use, and dressing can be omitted, thereby providing remarkable effects that can be industrially applied.

REFERENCE SIGNS LIST

Figure 1:
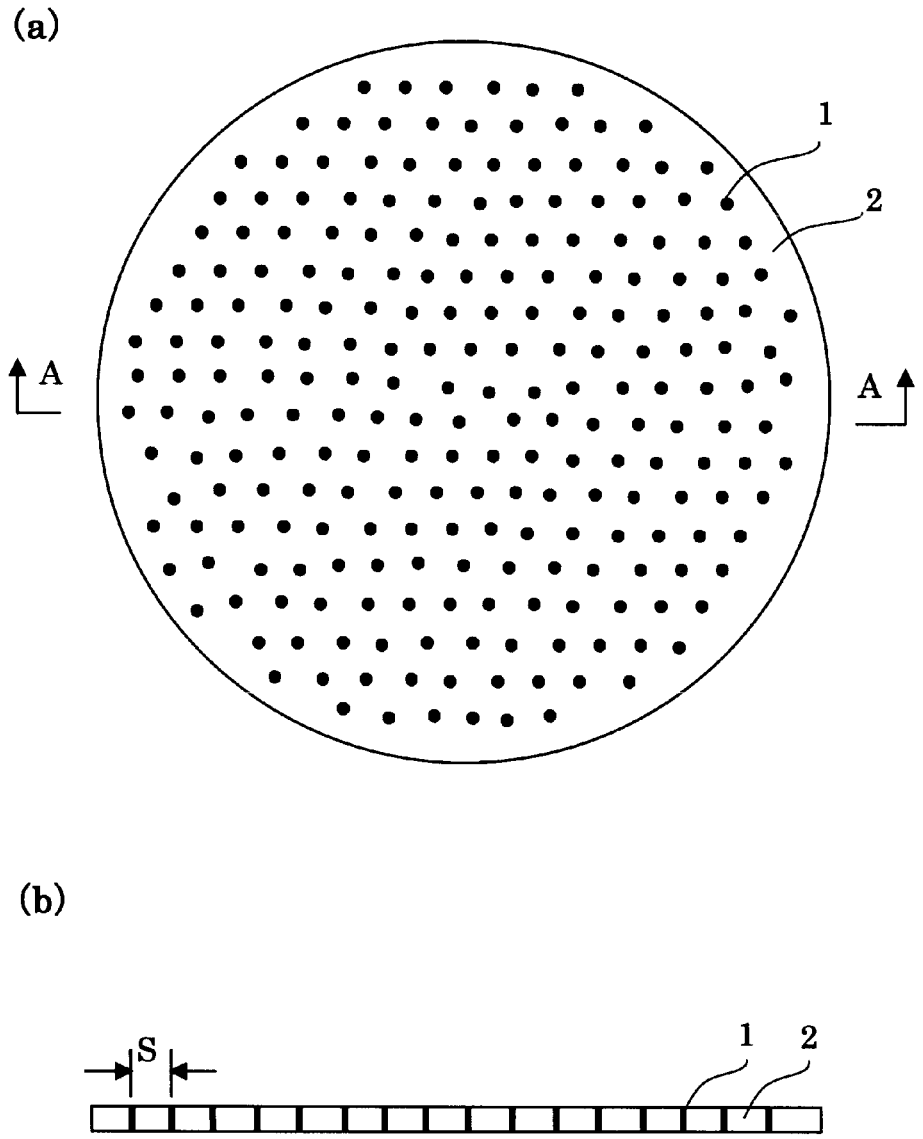
FIGS. 1(*a*) and 1(*b*) are a plan view and a cross-sectional view illustrating an example of a grindstone according to an embodiment of the present invention, respectively.

1 Grindstone pillar
2 Grindstone matrix
3 Abrasive grain
4 Binding agent
5 Pore
10 Grindstone
11 Working surface
12 Base end surface
15 Grinding/polishing layer
16 Grindstone base
17, 18 Fluid flow path
19 Supply and discharge port
20 Grindstone holder
22 Grindstone rotary shaft
25 Vacuum pump
29 Pressure pump
31 Vacuum chuck
L Axis of grindstone pillar
D Diameter of grindstone pillar
S Interval between grindstone pillars
W Workpiece

DESCRIPTION OF EMBODIMENTS

Figure 2:
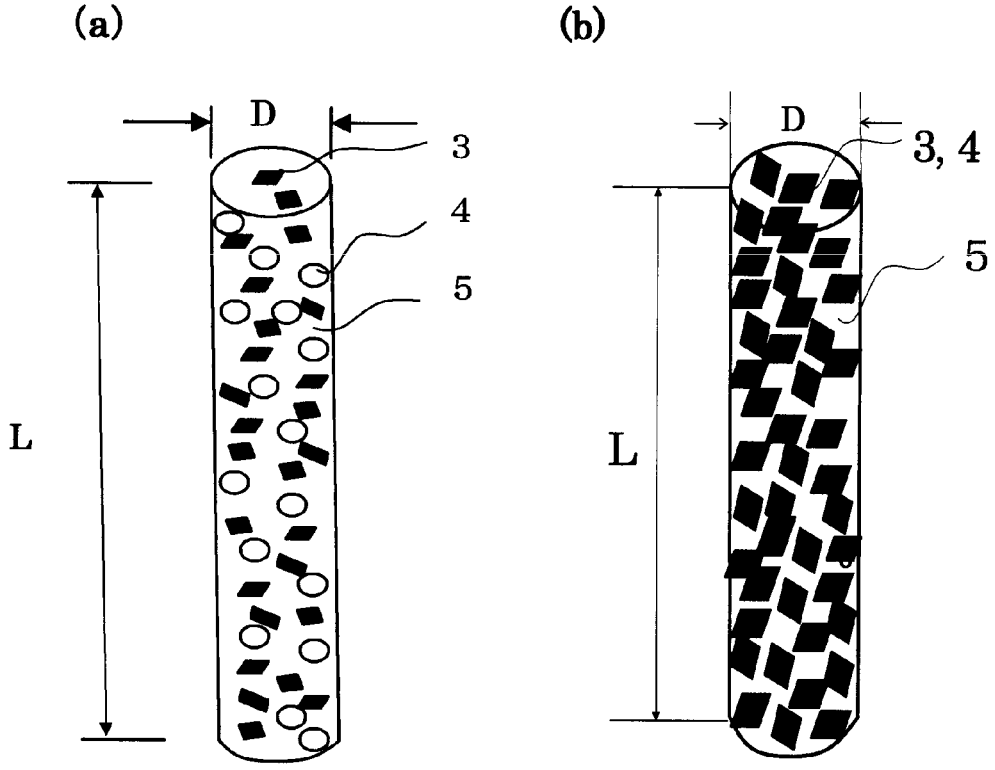
FIGS. 2(*a*) and 2(*b*) are schematic diagrams illustrating structures of grindstone pillars used in the present invention.

Embodiments of the present invention will be described below in detail based on the drawings. FIGS. 1(*a*) and 1(*b*) are a plan view and a cross-sectional view illustrating an example of a grindstone according to an embodiment of the present invention, and FIG. 1(*a*) is the plan view and FIG. 1(*b*) is the cross-section view taken along A-A in FIG. 1(*a*). Further, FIGS. 2(*a*) and 2(*b*) are schematic diagrams illustrating structures of grindstone pillars used in the present invention. FIG. 2(*a*) illustrates a state before sintering, and FIG. 2(*b*) illustrates a state after sintering. After sintering, binding agents are melted and wrap around abrasive grains to bind the abrasive grains one another. In FIGS. 1(*a*) to 2(*b*), reference sign 1 represents a grindstone pillar, 2 a grindstone matrix, 3 the abrasive grain, 4 the binding agent, 5 a pore, L an axis of the grindstone pillar, D a diameter of the grindstone pillar, and S an interval between the grindstone pillars.

As illustrated in FIGS. 1(*a*) and 1(*b*), the grindstone according to the present invention is a grindstone configured to grind/polish a workpiece and includes: the multiple grindstone pillars 1 arranged in parallel, including the binding agents 4 and the abrasive grains 3 configured to grind/polish the workpiece, and each having the axis L in a depth direction of a grinding/polishing surface; and the grindstone matrix 2 integrally formed with the grindstone pillars 1. Workpieces to be processed by the present invention are intended to include ceramics, a silicon wafer, SiC, alumina, sapphire, metal, alloy, and so on. Further, grinding/polishing in the present specification is intended to indicate both grinding and polishing.

The grindstone according to the present invention includes the multiple grindstone pillars 1 arranged in parallel, including the binding agents 4 and the abrasive grains 3 configured to grind/polish the workpiece, and each having the axis L in a depth direction of a grinding/polishing surface. Therefore, even when an abrasive grain 3 exposed on the grinding/polishing surface falls off, a processing speed can be maintained by exposing an abrasive grain 3 buried in a lower layer while continuing grinding/polish. The binding agents 4 are mixed as illustrated in FIGS. 2(*a*) and 2(*b*), but after sintering, the binding agents 4 are melted and bind the abrasive grains 3 in a manner wrapping around the abrasive grains 3, thereby forming pillars. Note that a cross-sectional shape of the grindstone pillar 1 is not limited to a circular cylinder as illustrated in FIGS. 2(*a*) and 2(*b*) and may have a rectangular cylinder shape.

The grindstone pillars 1 may be arranged in geometric patterns including a triangle, a rectangle, and a polygon as illustrated in FIGS. 1(*a*) and 1(*b*), and also may be placed at random.

Note that diamond is used as the abrasive grain 3 and an average grain diameter thereof is 0.1 to 300 μm. However, instead of using diamond, abrasive grains of cubic boron nitride (CBN), namely, CBN may be used as well, and also mixture of diamond and CBN may be used, too. Further, silicon carbide SiC, namely, GC, mullite ($3AL_2O_3$-$2SiO_2$), or fused alumina $AL_2O_3$, namely, a single body of WA, or mixture thereof may be used as well. As the binding agents 4 constituting the grindstone 10, vitrified bond is used, but for respective binding agents 4, various kinds of bond such as resinoid bond, metal bond, and electro-deposition bond can be used besides the vitrified bond. Meanwhile, in the case where the cross-section of the abrasive grain 3 does not have a circle shape, an average value of diameters of equivalent circles having the same cross-section area is adopted as the average grain diameter of the abrasive grains 3.

Further, in the case where the workpiece is plate-like shaped, the grindstone 10 of the present invention may be formed in a disk-like shape having a flat surface with the thickness of 5 to 10 mm as illustrated in FIGS. 1(*a*) and 1(*b*) But, by forming the surface to grind/polish the workpiece in a curved surface, a workpiece having a complex shape can be ground/polished by, for example, arranging the multiple grindstone pillars 1 at an outer periphery of the disk-like shaped grindstone. The multiple grindstone pillars 1 are arranged in parallel and each thereof has the axis L in a radial direction of the disk-like shape.

Further, preferably, both the grindstone pillars 1 and the grindstone matrix 2 include the abrasive grains 3 and binding agents 4, and the abrasive grains 3 inside the grindstone pillars 1 have hardness higher than the abrasive grains 3 of the grindstone matrix. Both the grindstone pillars 1 and the grindstone matrix 2 include the abrasive grains 3 and the binding agents 4, and the abrasive grains 3 inside the grindstone pillars 1 have the hardness higher than the abrasive grains 3 of the grindstone matrix 2. Therefore, the grindstone matrix 2 has more abrasion than the grindstone pillars 1, and the grindstone matrix 2 sinks deeper than the grindstone pillars 1. This effect is also enhanced by a difference of Young's moduli. As a result, the abrasive grains of the abrasive grain pillars can be constantly kept exposed and a hard and fragile workpiece such as an electronic material can be ground/polished.

Further, preferably, the grindstone pillar 1 and the grindstone matrix 2 are porous bodies having porosity of 20 to 60 volume %. A reason for specifying a lower limit (20%) of the porosity is that, in the case where a porous body has the porosity of 20% or less, most of the pores 5 are closed rather than opened, and flow of air and/or coolant for vacuuming cannot be performed. A reason for specifying an upper limit (60%) of the porosity is that mixed powder including the abrasive grains 3 and the binding agents 4 is about 60% at maximum and the powder is surely reduced to 60% or less due to the sintering performed afterward. Therefore, the upper limit is 60%. Since the grindstone pillars 1 and the grindstone matrix 2 are the porous bodies having the porosity of 20 to 60 volume %, following functions and effects can be provided.

By forming the grindstone pillars as the porous bodies, the grindstone surface can be vacuumed and a distance between the abrasive grains and a grinding object can be made closer.

By forming the grindstone as the porous body, the distance between the grindstone and the grinding object can be controlled, and a material to be processed can be prevented from needlessly being adhered to the grindstone by directly discharging the coolant such as water.

Cooling and polishing in the grindstone processing can be performed by directly discharging the coolant such as water from the grindstone.

Further, cooling liquid, slurry containing a chemical polishing agent, or mixture thereof can be supplied between the workpiece and the grindstone via the pores 5.

Further, pressure between the workpiece and the grindstone can be reduced by using a vacuum device such as a vacuum pump via the pores 5 and the pores inside the grindstone matrix.

Additionally, a grinding/polishing device providing the following functions and effects can be achieved by using the above-described grindstone.

Vacuuming can be performed from the grindstone surface.

The mechanism capable of discharging the coolant such as water from the grindstone can be implemented.

Dressing for a grinding stone can be omitted.

Rough grinding, lapping grinding, finishing polishing can be simultaneously performed.

Figure 3:
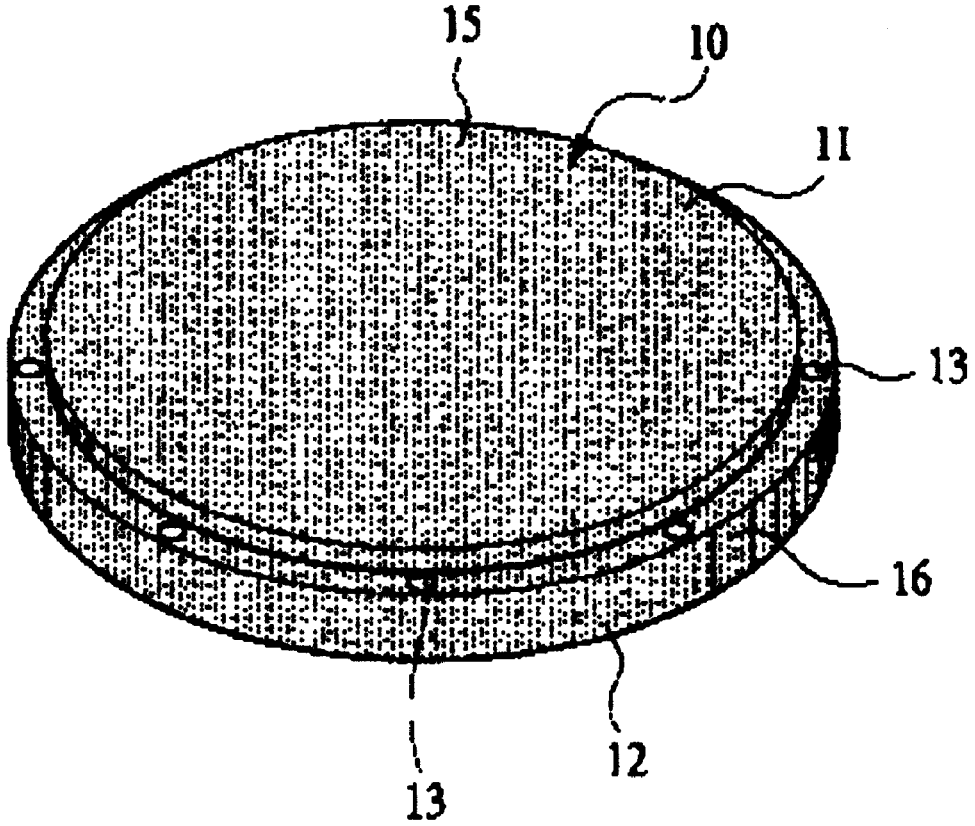
FIG. 3 is a perspective view illustrating an example of the grindstone according to an embodiment of the present invention.
Figure 4:
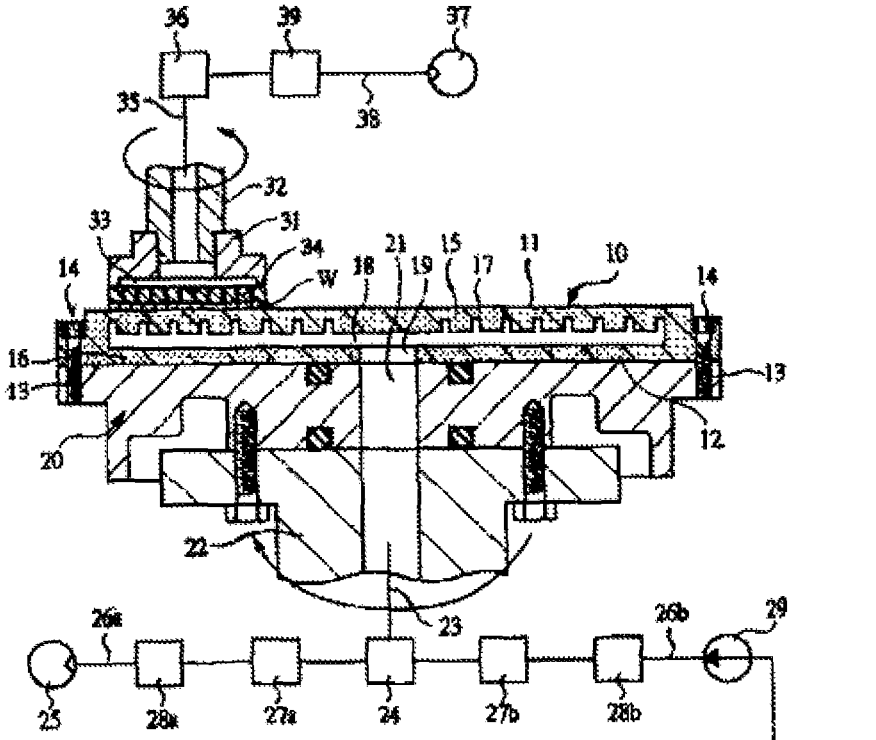
FIG. 4 is a diagram illustrating an example of a grinding/polishing device according to an embodiment of the present invention.

FIG. 3 is a perspective view of the grindstone according to an embodiment of the present invention, and FIG. 4 is a cross-sectional view illustrating a state in which the grindstone illustrated in FIG. 3 is set at a grindstone holder. In the following embodiment, an example in which a workpiece is a silicon wafer will be described.

A grindstone 10 illustrated in FIG. 3 has a circular shape, namely, a disk-like shape as a whole, and one end surface is a working surface 11 and the other end surface is a base end surface 12. As illustrated in FIG. 4, the grindstone 10 is set such that the base end surface 12 is butted against a grindstone holder 20, and is rotationally driven by the grindstone holder 20. The grindstone 10 is passed through a fixing hole 13 formed on an outer peripheral portion thereof, and fixed to the grindstone holder 20 with a bolt 14 screw-connected to the grindstone holder 20.

The grindstone 10 includes abrasive grains and binding agents configured to bind the abrasive grains one another, and is formed as a porous body formed with fine pores 5 inside thereof.

As illustrated in FIG. 4, the grindstone 10 is mounted on a grindstone rotary shaft 22 of a polishing device via the grindstone holder 20, and the grindstone 10 is rotationally driven by a motor not illustrated configured to drive the grindstone rotary shaft 22 via the grindstone holder 20. A fluid guiding flow path 23 formed at the grindstone rotary shaft 22 is connected to a vacuum pump 25 via a rotary joint 24, and a flow path on-off valve 27*a* and a pressure adjustment valve 28*a* are mounted on a fluid guiding flow path 26*a* connecting the vacuum pump 25 and the rotary joint 24. Therefore, when the vacuum pump 25 is actuated while the flow path on-off valve 27*a* is opened, the pores 5 of a polishing layer 15 becomes in communication with the vacuum pump 25 via the fluid guiding flow path 23, thereby generating a vacuum state, namely, a negative state in which pressure becomes lower than atmosphere pressure. As a result, the abrasive grains of the grindstone 10 can effectively work into a monument workpiece.

A pressure pump 29 is connected to the rotary joint 24, and a flow path on-off valve 27*b* and a pressure adjustment valve 28*b* are mounted on the fluid guiding flow path 26*b* connecting the pressure pump 29 to the rotary joint 24. The pressure pump 29 pressurizes and discharges liquid such as polishing liquid stored inside a container 30, and when the pressure pump 29 is actuated while the flow path on-off valve 27*b* is opened, the liquid enters the inside of the pores 5 of the polishing layer 15 via the fluid guiding flow path 23 and flows out from the working surface 11.

A workpiece rotary shaft 32 attached with a vacuum chuck 31 is disposed above the grindstone rotary shaft 22. The vacuum chuck is configured to support and rotate a workpiece W such as a silicon wafer. The workpiece rotary shaft 32 is horizontally movable in a direction along the working surface 11 of the grindstone 10, and also movable in a vertical direction, and therefore, capable of moving the workpiece W supported by the vacuum chuck 31 in both directions to be close to or distant from the grindstone 10. Further, pushing force against the workpiece W can be applied by own weights of the workpiece rotary shaft 32 and the vacuum chuck 31 in a state that the workpiece W is made to contact the grindstone 10. In addition to the pushing force by the own weights, thrust can be applied to the workpiece rotary shaft 32 by a pneumatic cylinder or the like so as to add the pushing force against the workpiece W.

The vacuum chuck 31 includes a chuck plate 34 on which a plurality of air suction holes 33 is formed, and a vacuum flow path 35 communicating with each of the air suction holes 33 is formed on the workpiece rotary shaft 32. The vacuum flow path 35 is connected to a vacuum pump 37 via the rotary joint 36, and a flow path on-off valve 39 is mounted on a vacuum supply path 38 connecting the vacuum pump 37 to the rotary joint 36. Therefore, when pressure of the vacuum flow path 35 is reduced lower than the atmosphere pressure by actuating the vacuum pump 37, external air enters the inside of the air suction hole 33 and the workpiece W is sucked in vacuum and held by the vacuum chuck 31. Further, double-surface processing can be performed on a grinding object W by attaching an upper structure homologous with the structure of the above-described grindstone. In this case, W is hold by a sheet-like holder provided with a hole shaped like W.

Polishing using the grindstone 10 includes following processing: polishing for a workpiece W whereby coolant is pressurized by the pressure pump 29 and flown out from the working surface 11 via the fluid flow path 17, and polishing whereby a wafer surface before forming a circuit pattern or a wafer surface formed with the circuit pattern is polished by adjusting, through the working surface 11, pressure between the working surface 11 and the workpiece W, that is, a distance between the abrasive grain and a surface to be processed. Further, the above polishing is applicable to: polishing for a workpiece W whereby polishing liquid containing floating abrasive grains is pressurized by the pressure pump 29 and flown out from the working surface 11 via the fluid flow path 17; and polishing whereby a wafer surface before forming a circuit pattern or a wafer surface formed with the circuit pattern is polished by flowing out slurry containing a chemical polishing agent from the working surface 11, namely, a CMP processing. In this kind of polishing, the polishing liquid or the like is supplied between the grindstone 10 and the workpiece W from the working surface 11. Therefore, the polishing liquid can be surely supplied to an entire surface of the workpiece W to be processed. Furthermore, since the grindstone 10 has the working surface 11 having higher hardness compared to a polishing pad formed of urethane, etc. as the general CMP processing, no undulation and the like are generated on the wafer surface and the polishing can be performed with high flatness. Further, by adjusting the pressure between the working surface 11 and the workpiece W, a polishing period and a polishing amount can be easily set.

To manufacture the grindstone 10 formed with the fluid flow paths 17, 18, mixture of an abrasive grains, binding agents, and auxiliary agents is injected into a shaping die. On the other hand, a core made of an eliminable material such as an eliminable resin eliminated by heating is preliminarily manufactured in shapes of the fluid flow paths 17, 18, and when the mixture is injected into the shaping die, the core is inserted into the mixture. By heating a grindstone material formed into a shape corresponding to the grindstone 10 in a furnace, the core is eliminated and the abrasive grains are bound by the binding agents, and the grindstone 10 formed of a porous body having the pores 5 inside thereof and formed with the fluid flow paths 17, 18 is integrally manufactured. The porosity of the grindstone 10 is reduced when an amount of the auxiliary agents is increased, but the porosity can be also adjusted by a sintering temperature, etc. besides the amount of the auxiliary agent.

Therefore, in the case of forming the grindstone 10 including the polishing layer 15 and a grindstone base 16 as described above, the amount of the auxiliary agents is differentiated between the polishing layer 15 and the grindstone base 16. Thereby achieving to form the polishing layer 15 and the fluid flow path 17 (portion having thickness t+t1), a portion formed with as a porous body of an open-pore structure, and the grindstone base 16 a portion on a side closer to the base end surface 12 as a porous body of a closed-pore structure.

As the abrasive grains 3 constituting the grindstone pillars 1, diamond, namely, diamond abrasive grains are used, and an average grain diameter thereof is 0.1 to 300 μm. However, instead of using diamond, abrasive grains of cubic boron nitride (CBN), namely, CBN may be used as well, and also mixture of diamond and CBN may be used. Furthermore, silicon carbide SiC, namely GC, mullite ($3Al_2O_3$-$2SiO_2$), or fused alumina $Al_2O_3$, namely, a single body of WA or mixture of these may be used as well. As the binding agents constituting the grindstone 10, vitrified bond is used, but for respective binding agents, various kinds of bond such as resinoid bond, metal bond, and electro-deposition bond can be used besides the vitrified bond.

Prevention of clogging and double-surface processing which are the characteristics of the present invention will be described. The grindstone is not able to perform processing when dressing is necessary and also when clogging occurs. In the case of grinding/polishing a hard workpiece such as sapphire, clogging rarely occurs, but in the case of processing workpieces such as even ceramics softer than sapphire, metal, and alloy, clogging may occur. This is a phenomenon in which scraped fine powder is clogged between abrasive grains of the grindstone, and the grindstone surface becomes flat, thereby decreasing protrusion height of the abrasive grains and becoming unable to perform machining. In the case of such a situation, according to the present grindstone, the clogged scraps can be removed by charging and discharging fluid (coolant such as water, or air) through the pores.

Further, the processing speed can be increased by performing double-surface processing. However, in the case of double-surface processing, particularly, in the case of processing a thin workpiece, the workpiece is adhered to the grindstone surface and cannot be removed due to surface tension of the coolant such as water, or in the case of processing numerous workpieces, some of the workpieces may adhered to one surface of the grindstone and some of the remaining workpieces may be adhered to the other surface of the grindstone. In such cases, automation and mass production cannot be executed.

Further, thickness of a thin workpiece such as a silicon substrate is becoming thinner and thinner, and there is a limit in processing such a substrate because, since one-side processing is applied, a difference is generated between a working surface and a non-processed surface and the substrate may have warpage and become unusable. Such warpage can be prevented by performing double-surface processing because both surfaces are changed in the same manner.

However, in the case of performing the double-surface processing with the grinding/polishing device in the related arts, the coolant such as water is injected. Therefore, when the workpiece is removed by lifting the grindstone after processing, the workpiece may be lifted being adhered to the grindstone located above or adhered to the grindstone located below due to the surface tension of the coolant. Consequently, an extra process to remove the adhered workpieces is increased, and in the case of failing in separating the workpiece, the thinned workpieces may be broken. Therefore, a double-surface processing device is generally used for the rough processing, and limited to use for relatively thick workpieces.

Considering such situations, the grindstone according to a preferred embodiment of the present invention is capable of preventing a workpieces from being adhered to the grindstone, and easily removing the workpiece by discharging fluid (either liquid such as water or gas such as air is fine) from the grindstone in the case where the workpiece is interposed between the grindstones placed on upper and lower sides of the workpieces. Further, since the workpieces can be easily removed, the double-surface processing can be performed.

Working Example

Using the embodiments of the present invention illustrated in FIGS. 1(*a*) to 4, a working example is implemented by setting the diameter D of the grindstone pillar at 1 to 2 mm within a range of 1 to 100 times of the average grain diameter of the abrasive grains 3, the interval S between adjacent grindstone pillars at 10 to 20 mm within a range of 10 to 1000 times of the diameter D of the grindstone pillar, and the porosity of the grindstone pillar and the grindstone matrix at 30 to 60%, in accordance with the scope of the present invention. A percentage of total cross-sectional area of the grindstone pillars with respect to area of a grinding/polishing surface of the grindstone is 0.4 to 7.0%, which is a value lower than the related arts. Note that diamond having the average grain diameter 20 μm is used as the abrasive grain.

Figure 5:
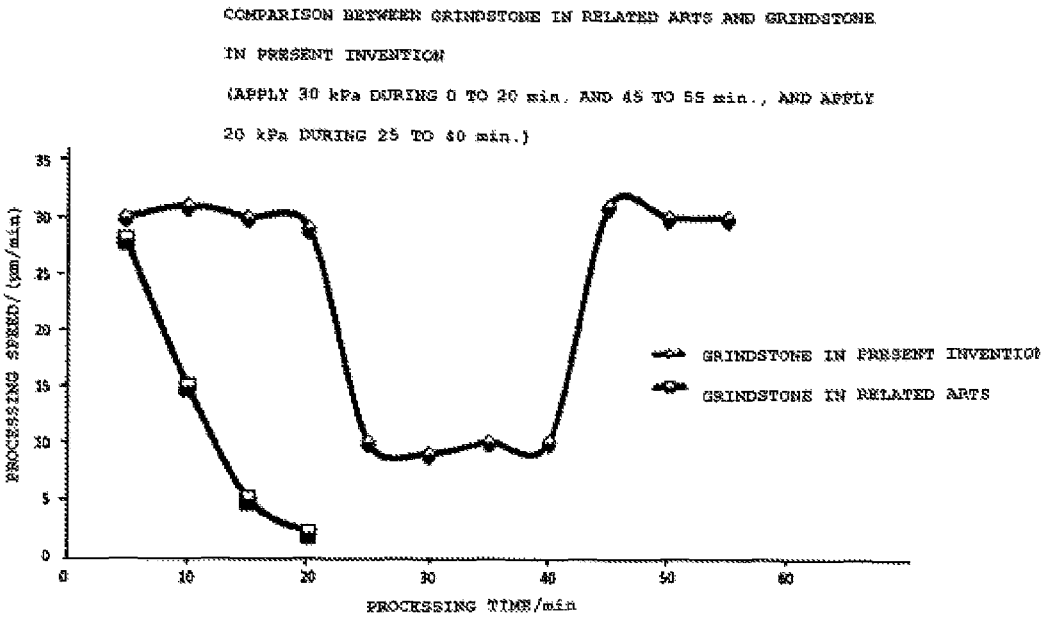
FIG. 5 is a diagram illustrating effects of the present invention.

FIG. 5 is a diagram illustrating effects of a working example in the case where diamond is used as the abrasive grains and sapphire is used as a workpiece in the present invention. As illustrated in FIG. 5, in the case of using the grindstone according to the present invention, the processing speed of grinding/polishing is maintained even though pushing force against the workpiece is reduced from 30 kPa to 20 kPa and then is returned to 30 kPa again, thereby confirming the effect of the present invention. On the other hand, according to the grindstone in the related arts, the processing speed slows down in first 20 minutes, and dressing is needed to be performed. Consequently, processing can be hardly continued without dressing. According to the grindstone of the present invention, it is proved that the processing speed is recovered by putting back the applied pressure without performing dressing, and it is shown that the processing can be achieved without dressing.

According to the present invention, following effects can be obtained by using the abrasive grains used in the rough processing and improving cutting quality of the abrasive grains such as diamond.

- Much more high-speed processing than the general rough processing can be performed.
- Defects generation during the rough processing are reduced.
- A finishing surface of the rough processing is smooth, and lapping and polishing after the rough processing can be omitted.
- A grinding speed can be controlled during the rough processing so as to obtain dimensional accuracy.
- High efficiency of processing can be achieved because the processing from the rough processing to precision processing is performed in a setup of the same processing machine.
- High efficiency of processing can be achieved because the double-surface processing is performed from the rough processing to the precision processing in the same processing machine.

The invention claimed is:

1. A grindstone configured to grind or polish workpieces, comprising:

multiple grindstone pillars arranged in parallel, each of said grindstone pillars including a binding agent and abrasive grains configured to grind or polish the workpieces, and each of said grindstone pillars having an axis L in a depth direction of a grinding or polishing surface; and a grindstone matrix integrally formed with the grindstone pillars, wherein the grindstone matrix includes other abrasive grains and another binding agent, wherein the abrasive grains inside grindstone pillars have hardness higher than the other abrasive grains inside the grindstone matrix, and wherein the grindstone pillars and the grindstone matrix are porous bodies having porosity of 20 to 60 volume %, and wherein a percentage of the total cross-sectional area of the grinding pillars with respect to an area of a grinding or polishing surface of the grindstone is not more than 7.0%.

2. The grindstone according to claim 1, wherein a surface configured to grind or polish the workpieces is a flat surface or a curved surface.

3. The grindstone according to claim 1, wherein the grindstone pillars are located inside and extend through the grindstone matrix.

4. The grindstone according to claim 3, wherein a coolant including a cooling liquid, gas, or slurry containing a chemical polishing agent, or mixture of the cooling liquid, gas, or slurry is injected between the workpieces and the grindstone via the pores.

5. The grindstone according to claim 3, wherein the pressure between the workpieces and the grindstone is reduced via the pores by using a vacuum device.

6. The grindstone according to claim 1, wherein said grindstone includes two grindstone portions that are configured for double-surface processing by attaching respective ones of the two grindstone portions to opposing surfaces of workpieces.

7. The grindstone according to claim 1, wherein the grindstone is configured to be prevented from clogging and processed by directly discharging liquid or gas in a continuous or pulse-like manner from a rear portion of the grinding or polishing surface of the grindstone.

8. The grindstone according to claim 1, wherein workpieces are prevented from being adhered to the grinding/polishing surface, and the workpieces are easily removed after processing by directly discharging liquid or gas from the rear portion of the grinding or polishing surface of the grindstone.

9. A grinding or polishing device, including a grindstone according to claim 1, a grindstone holder for holding said grindstone and a workpiece holder for holding a workpiece to be grinded or polished relative to said grindstone.

10. The grindstone according to claim 1, wherein a percentage of the total cross-sectional area of the grinding pillars with respect to an area of a grinding or polishing surface of the grindstone is between 0.4 to 7.0%.

11. A method of using a grinding or polishing device employing a grindstone, comprising:

1) providing a grinding or polishing device employing a grindstone configured to grind or polish workpieces, having:

multiple grindstone pillars arranged in parallel, each of said grindstone pillars including a binding agent and abrasive grains configured to grind or polish the workpieces, and each of said grindstone pillars having an axis L in a depth direction of a grinding or polishing surface; and a grindstone matrix integrally formed with the grindstone pillars, wherein the grindstone matrix includes other abrasive grains and another binding agent, wherein the abrasive grains inside grindstone pillars have hardness higher than the other abrasive grains inside the grindstone matrix, wherein the grindstone pillars and the grindstone matrix are porous bodies having porosity of 20 to 60 volume %, and wherein a percentage of the total cross-sectional area of the grinding pillars with respect to an area of a grinding or polishing surface of the grindstone is not more than 7.0%;

(2) using the grinding or polishing device employing the grindstone including injecting the coolant between the workpieces and the grindstone via the pores.

* * * * *